United States Patent [19]

Kinge et al.

[11] Patent Number: 4,883,957

[45] Date of Patent: Nov. 28, 1989

[54] MASS SPECTROMETER INCLUDING COOLING FOR THE ION COLLECTION AMPLIFIERS

[75] Inventors: Nigel Kinge, Sandbach; Neil E. Sanderson, Sandiway; David J. Mills, Northwich, all of England

[73] Assignee: VG Instruments Group Limited, Crawley, England

[21] Appl. No.: 179,426

[22] Filed: Apr. 8, 1988

[30] Foreign Application Priority Data

Apr. 9, 1987 [GB] United Kingdom ..... 8708502

[51] Int. Cl.[4] ..... H01J 49/00

[52] U.S. Cl. ..... 250/283; 250/281; 250/282; 250/288; 250/289

[58] Field of Search ..... 250/281, 282, 283, 284, 250/288, 289; 330/289

[56] References Cited

U.S. PATENT DOCUMENTS

| | | | |
|---|---|---|---|
| 4,023,398 | 5/1977 | French et al. | 250/281 |
| 4,179,615 | 12/1979 | Kraus et al. | 250/283 |
| 4,370,615 | 1/1983 | Whistler et al. | 324/457 |
| 4,413,235 | 11/1983 | Jason | 330/289 |
| 4,475,103 | 10/1984 | Brokaw et al. | 330/289 |
| 4,495,413 | 1/1985 | Lerche et al. | 250/281 |
| 4,763,002 | 8/1988 | Zermeno et al. | 250/370.01 |

*Primary Examiner*—Carolyn E. Fields
*Assistant Examiner*—John A. Miller
*Attorney, Agent, or Firm*—Chilton, Alix & Van Kirk

[57] ABSTRACT

The invention comprises a mass spectrometer adapted for the determination of isotopic ratios which has several ion-collecting means disposed along its mass focal plane. Separate current amplifier means are provided for each ion collecting means and comprise an electrometer amplifying element, and an input resistor disposed in an inner box, itself disposed within a sealed evacuated housing. Means are provided for cooling the amplifier element to a temperature substantially below 20° C. Means are provided for maintaining the temperature of at least the input resistor substantially constant. Cooling the amplifier element, typically to between 0° and 5° C., results in an unexpected reduction in low frequency noise which allows the time required to determine an isotope ratio to be reduced, thereby substantially increasing sample throughout.

21 Claims, 6 Drawing Sheets

MASS SPECTROMETER INCLUDING COOLING FOR THE ION COLLECTION AMPLIFIERS

This invention relates to mass spectrometers provided with at least one ion collector which generates very small ion currents, for example isotope-ratio mass spectrometers which are fitted with a plurality of such collectors in order to permit simultaneous measurement of the intensity of several ion beams, each comprising ions of different mass-to-charge ratios.

Isotope ratio mass spectrometers having more than one ion collector are well known in the art, for example, the five-collector instrument described by Stacey, et al, in International Journal of Mass Spectrometry and Ion Physics, 1981, vol. 39, pp 167–180. When it is desired to make an accurate measurement of the intensity of a beam of ions of a particular mass-to-charge ratio, or to accurately determine the intensity ratio of two or more beams of different mass-to-charge ratios, it is known to provide an ion collector on which the beam to be measured impinges. The current which flows to ground from this collector is determined by the charge transferred to it by the incident ions, and measurement of the current consequently allows the intensity of the beam to be determined. Isotope-ratio mass spectrometers are fitted with a number (up to ten) of such collectors disposed along the mass focal plane and spaced so that each collector receives only ions of one particular mass-to-charge ratio.

Typically the collectors comprise Faraday cups which are arranged to trap secondary electrons and ions which may be released on impact of the incident ion with the surface of the collector, so that no charge can leave the collector except through the current measuring circuit. A typical collector system is disclosed in European patent application No. 81371.

Separate electrometer amplifiers are provided to simultaneously measure the currents flowing at each collector so that the ion beam intensity ratio can be accurately determined at any instant. This allows accurate measurement of the isotopic composition of the sample from which the ions are generated, irrespective of fluctuations in the actual intensity of the ion beams.

The electrometer amplifiers employed must be capable of accurately measuring very small ion currents (eg $10^{-13}$A) in order for the spectrometer to have adequate sensitivity, and be sufficiently stable for an ion current ratio to be determined to approximately 1 part in $10^6$. In some cases an isotope-ratio measurement may extend over a period of ½ hour or longer, and the relative sensitivity of the amplifiers must be maintained constant over at least this period. A conventional way of achieving this high degree of stability is to provide automatic repetitive calibration of the amplifiers, for example as described in U.S. Pat. No. 4,495,413.

In order to obtain adequate sensitivity, the electrometer amplifiers usually incorporate input resistors of a very high value, for example 100GΩ. Obviously, the resistance of a resistor of this value is likely to be significantly reduced by the contamination of its surface by water, etc, and to avoid this it is known to enclose the amplifier in an evacuated housing maintained at a pressure of less than about 1 torr. Further, the temperature of the amplifier and the input resistor is conventionally controlled within ± 0.01° C. in order to reduce drift due to ambient temperature variations. This necessitates heating the amplifier to approximately 40° C..

The electrometer amplifiers conventionally employed incorporate operational amplifiers in integrated circuit form which are specially designed as high sensitivity, high stability D.C. electrometer amplifiers and which have very low input bias and offset currents. Nevertheless, especially when the amplifiers are heated to permit temperature control, and thus reduce drift these currents are large enough to require electrical compensation. The extent of compensation is of course different for each device and considerable time is needed to accurately adjust the compensation for the typical ten amplifiers of a single spectrometer, especially when their operating temperature is not room temperature and they are enclosed in an evacuated housing. In addition, extra complexity is introduced into the amplifier circuitry to provide the compensation, and any variation in the properties of the compensation circuitry will be reflected as an error in the measured ion currents.

It is the object of the present invention to provide a mass spectrometer having at least one ion collecting means equipped with a direct current amplifier for measuring the intensity of an ion beam incident upon it, which has greater stability and is easier to set up than previously known types.

According to the invention there is provided a mass spectrometer comprising at least one ion collecting means disposed to receive ions subsequent to their mass analysis and produce an electrical current substantially proportional to the number of ions striking it, at least one current amplifier means for amplifying said electrical current, said amplifier means being disposed in a substantially sealed housing and comprising a plurality of electronic components, at least one of which is an amplifying element, means for maintaining the pressure within said sealed housing at a pressure substantially less than atmospheric pressure, means for cooling at least said amplifying element to a temperature substantially less than 20° C., and means for maintaining substantially constant the temperature of at least one of said electronic components.

In a preferred embodiment the mass spectrometer of the invention is an isotope ratio mass spectrometer adapted for the simultaneous determination of a plurality of ion currents due to different isotopic species impinging on a plurality of ion collecting means. The ion collecting means typically comprise Faraday cup collectors disposed along the mass focal plane of the spectrometer and spaced apart so as to each receive only ions of a particular mass-to-charge ratio. Each Faraday cup collector is connected via a vacuum tight electrical feedthrough in the wall of the mass spectrometer detector housing to a separate current amplifier means.

As in a conventional spectrometer, each current amplifier means comprises an amplifying element (preferably an integrated circuit electrometer amplifier having very low input offset and bias currents) and a very high value resistor (typically 100 GΩ), connected to one of its inputs. Use of such an amplifier allows currents of between $10^{-13}$ and $10^{-14}$ amps to be accurately measured.

The current amplifying means is enclosed in a sealed housing, maintained at a pressure of between $10^{-3}$ and 1 torr in order to prevent contamination by water and other materials adversely affecting the very high resistance input resistor and reducing the accuracy of the current measurement.

In a preferred embodiment, at least the amplifying element is cooled to a temperature below 10° C., and in a further preferred embodiment it is cooled to within the range 0-5° C.. Lower temperatures can also be used, but tend to result in condensation adversely affecting the components when air is admitted into the sealed housing to facilitate servicing.

According to the invention, means are also provided to control the temperature of at least some of the electronic components comprising the current amplifier means.

Typically, the current amplifier means comprises a resistor connected to an input of the amplifying element. In a preferred embodiment, the temperature of this input resistor is maintained substantially constant, preferably within ±0.1° C., and further preferably within ±0.01° C.. In prior amplifiers, temperature control of the input resistor is achieved by heating the amplifier to about 40° C., in order to achieve an adequate temperature differential for control purposes. However, in an amplifier according to the invention it is preferable to cool the input resistor to substantially the same temperature as that of the amplifying element.

According to a further preferred embodiment the invention comprises a mass spectrometer as defined above in which said current amplifier means is disposed in an inner box at least partly constructed from a thermally conducting material, said inner box is disposed within said amplifier housing, a continuous thermally conducting path is provided between said inner box and said amplifying element, and said means for cooling is adapted to cool said inner box.

Preferably the amplifying element is an integrated circuit electrometer amplifier and is mounted on a circuit board having a thermally conducting metallic coating, for example, a ground plane. The case of the integrated circuit is mounted in good thermal contact with the coating. Preferably the integrated circuit has a metallic case which can be soldered to the coating. In a further preferred embodiment the amplifying element is mounted as close as possible to the edge of the board, which is located in a groove in at least one of the walls of the inner box, which are typically made of copper. Thermally conducting spring means, typically copper springs, are mounted on the board and provide a thermally conducting path between the coating and the the inner box. The inner box may be adapted to receive a plurality of boards each carrying separate electrometer amplifiers, one for each of the ion collecting means, and may also be adapted to provide electrical screening between them. In a further preferred embodiment, the input resistor is disposed to allow radiative transfer of heat between its surface and that of the inner box, and the means for maintaining the temperature substantially constant is adapted to control the temperature of the inner box. The temperature of the resistor is therefore controlled by virtue of the radiative coupling. Preferably the temperature of the inner box is controlled to within ±0.002° C., so that the temperature of the input resistor may be controlled to within ±0.01° C..

In a still further preferred embodiment, the means for cooling comprises at least one heat pump means disposed between the inner box and the sealed housing. The heat pump means may conveniently comprise Peltier effect devices.

A particular benefit which unexpectedly results from cooling the amplifier element substantially below 20° C. is that the low frequency noise generated by the amplifier is very significantly reduced. For example, the RMS noise measured over an integration period of 5 seconds has been found to be reduced from $3\times10^{-16}$ amps for an amplifying element operating at +40° C. to $1.4\times10^{-16}$ amps for the same amplifying element operating at 5° C.. This reduction in low frequency noise is not predicted from the specifications of electrometer amplifiers, and the reduction makes it possible to reduce the time taken to determine an isotopic ratio to a given accuracy by almost a factor of 2 in comparison with a prior spectrometer.

Alternatively, the precision of the ratio measurement may be increased by up to a factor of 2 by the use of a spectrometer according to the invention if the measurement is carried out for the same period of time as it is on the prior spectrometer.

Consequently, use of the invention can almost double the number of samples which can be analyzed in a given time, and greatly increases the cost effectiveness of the spectrometer.

A further benefit obtained by use of the invention is that the input bias and offset currents of the amplifying element are approximately one tenth of their values at 40° C.. The current which has to be fed into the input of the amplifier to compensate the offset and bias currents is therefore reduced to a very low level and the need for its accurate adjustment is reduced. In many applications, no compensating input current is needed at all. As a consequence, the stability of the amplifier is greatly improved and the need for adjusting and balancing the compensating currents is substantially eliminated.

The invention will now be described in greater detail and by way of example only with reference to the following figures, in which.

Figure 1:
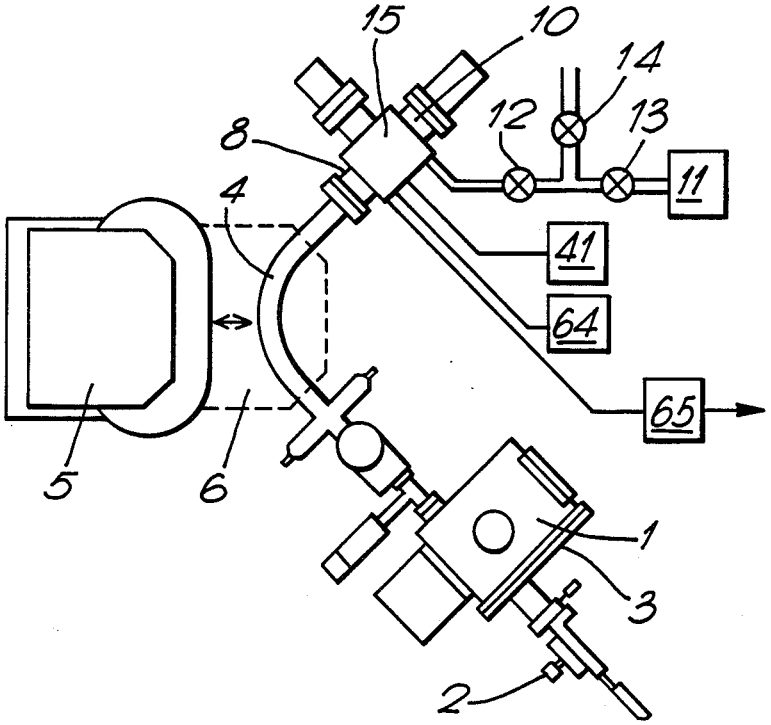
FIG. 1 is a schematic drawing of a mass spectrometer according to the invention.

Referring first to FIG. 1, a mass spectrometer according to the invention comprises an ion source contained in housing 1 and a sample introduction probe 2 attached to a flange 3 on housing 1. Ions formed in the source pass through flight tube 4 in a magnetic field created by electromagnet 5, which occupies location 6 when in use. Ions having different mass-to-charge ratios are dispersed along the focal plane and those having certain values of mass-to-charge ratios impinge on several ion collecting means 7 (FIG. 7), typically Faraday cup collectors disposed in the detector housing 8.

Typically the mass spectrometer is adapted for the isotopic analysis of a sample, and other mass spectrometer geometries, including double focusing types incorporating an energy analyser, may also be employed. In the embodiment shown in FIG. 7, ion collecting means 7 are each disposed to receive ions of a particular mass-to-charge value, thereby permitting the determination of one or more isotope ratios simultaneously, but it will be appreciated that the invention may alternatively provide a mass spectrometer with only one collector.

Figure 7:
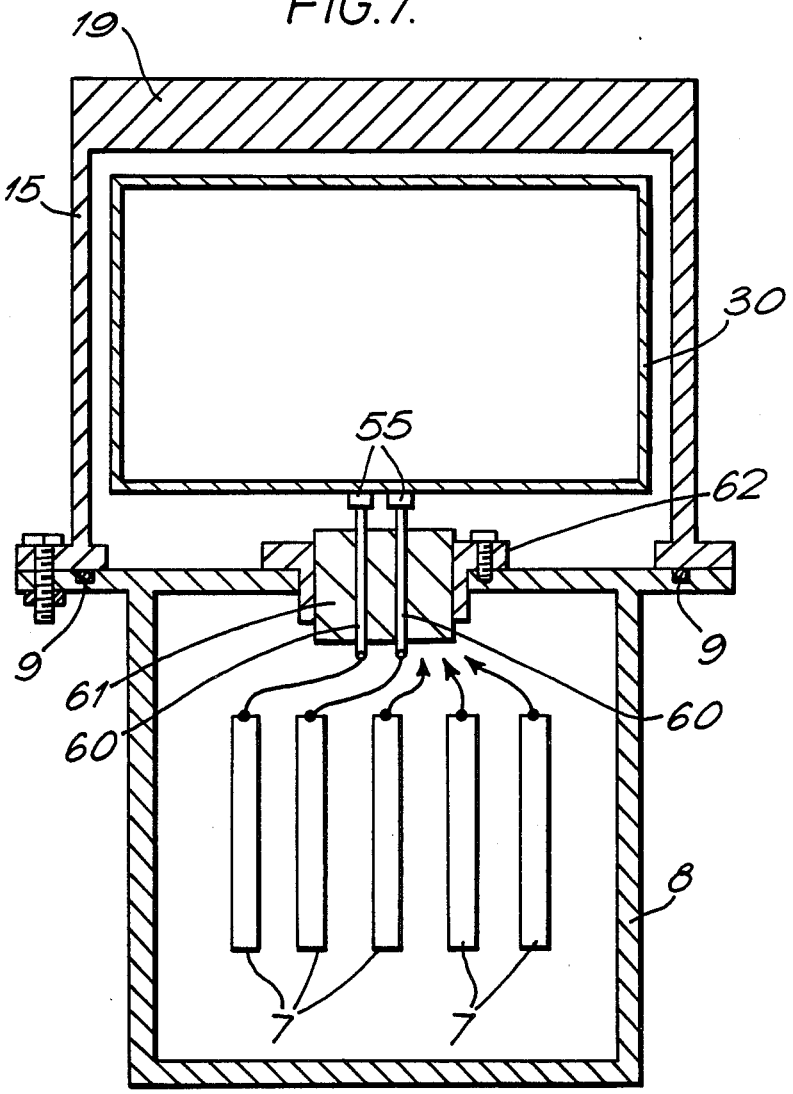
FIG. 7 is a sectional drawing of the detector housing and preamplifier assembly of a spectrometer according to the invention.

Detector housing 8 has a flat external face 10 which is adapted to receive the substantially sealed housing 15. An 'O' ring seal 9 is provided in a groove in the face 10 as shown in FIG. 7, and means 11, typically a small mechanical vacuum pump, are provided for maintaining the pressure in housing 15 substantially below atmospheric pressure. The vacuum pump is connected to housing 15 via valves 12 and 13, and valve 14 is provided to allow air into the housing to facilitate servicing.

A plurality of electrical feedthroughs 60 (FIG. 7) are mounted in an insulating block 61 in high vacuum flange 62 to permit connection to be made between the Faraday collectors 7 in housing 8 and the amplifiers disposed in the sealed housing 15. Feedthroughs 60 are positioned to contact spring loaded contact pads 55 (FIG. 7) which are connected to the inputs of the collector current amplifiers.

Figure 2:
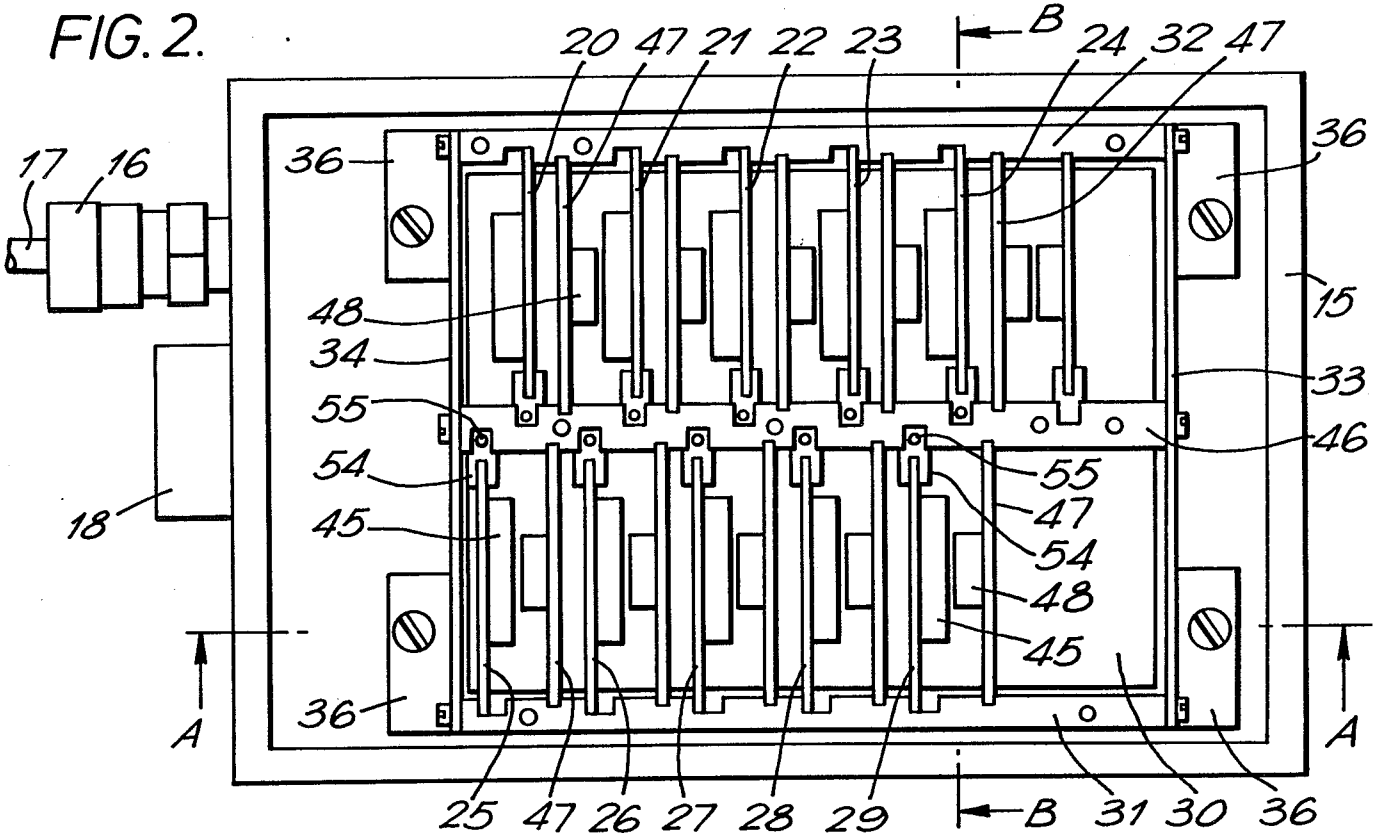
FIG. 2 is a plan view of a cooled preamplifier assembly suitable for use with the spectrometer of FIG. 1.
Figure 3:
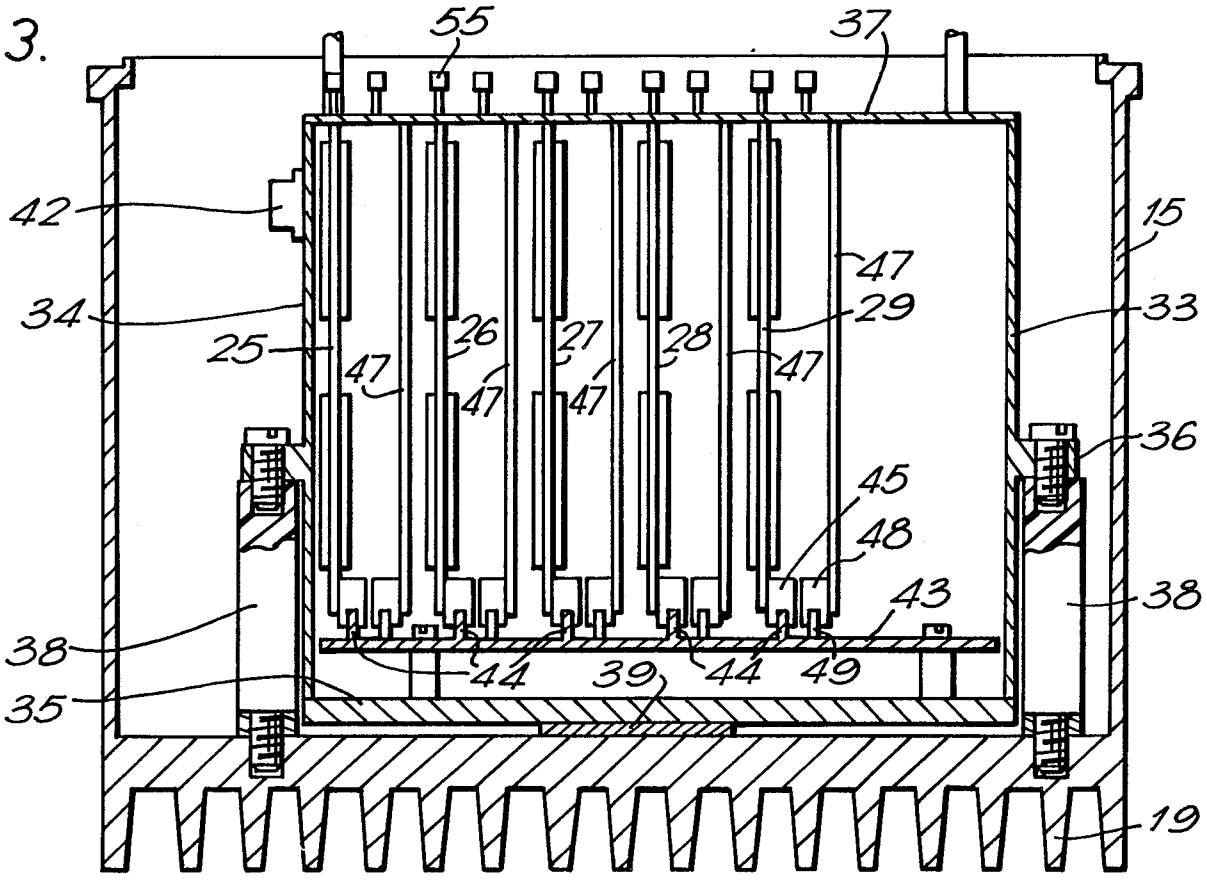
FIG. 3 is a sectional elevation of the assembly of FIG. 2 taken along plane A—A.

Referring next to FIG. 2, housing 15 is fitted with a pipe connector 16 to allow it to be evacuated through pipe 17, and a vacuum tight multi-way electrical connector 18 is also provided for power supplies and the output signals. Housing 15 comprises a cast aluminum box which incorporates a finned heat sink 19 (FIG. 3).

Contained within housing 15 are at least one current amplifying means 63 (FIG. 5) which comprises a plurality of electronic components 56, including an amplifying element 57 (typically an integrated circuit electrometer amplifier) and an input resistor 66, built on an amplifier printed circuit board (P.C.B.) 20,(for example). In the case of the embodiment illustrated in FIGS. 2–4, ten such current amplifying means are provided, built on printed circuit boards 20–29. These are fitted inside an inner box 30 which is constructed from two thick copper side plates 31 and 32, two thin copper end plates 33 and 34, and a copper base plate 35, all bolted together. A lid 37 (FIG. 3) is also fitted to the inner ox and secured by screws. Box 30 contains holes to ensure that its interior remains at the same pressure as the interior of housing 15. It is supported by four brackets 36 on end plates 33 and S4 and PTFE pillars 38 which are provided with threaded brass spigots screwed into the housing 15. These pillars provide thermal insulation between inner box 30 and housing 15.

Means for cooling at least the amplifying element 57 comprise two heat pumps 39,40, typically Peltier effect devices, which are disposed between base plate 35 and housing 15, in good thermal contact with both components and with their "hot sides" adjacent to housing 15. Electrical supplies to the heat pumps are connected via multi-way connector 18 from a suitable power supply and control unit 41. The heat pumps should be capable of maintaining a temperature gradient of at least 10° C., and preferably 20° C., between the inner box 30 and the housing 15 when heat sink 19 is at room temperature. Means comprising a temperature sensor 42 (FIG. 3) are provided for controlling the temperature of at least one of the electronic components in box 30. Sensor 42, typically a thermocouple, is mounted in good thermal contact with inner box 30, and is connected to unit 41. Unit 41 incorporates a conventional control circuit which adjusts the power fed to the heat pumps 39 and 40 to maintain the temperature of inner box 30 (and the amplifiers within it) at any desired temperature below 20° C.. The components 56, especially the input resistor 66, are disposed so that the maximum possible surface area is presented to the walls of the inner box 30, thereby allowing radiative transfer of heat between the components and the box.

The amplifier printed circuit boards 20–29 are supported on a "mother" printed circuit board 43 which is fitted with multiway edge connectors 44, each of which mates with a socket 45 on one of the boards 20–29. Any number of amplifier boards, and any other necessary boards such as power supply regulators and a constant current calibration source, may be fitted in box 30. Each P.C.B. 20–29 is located in grooves cut in side plates 31 or 32 and in a divider 46 which is fitted between end plates 33 and 34. Screening boards 47 are disposed between the amplifier printed circuit boards, also in grooves in side plates 31 and 32 and divider 46. The screening boards 47 each comprise a piece of double-sided printed circuit board fitted to a short edge socket 48 which engages with one of the edge connectors 49 on the "mother" board 43. Divider 46 is made of PTFE.

Figure 4:
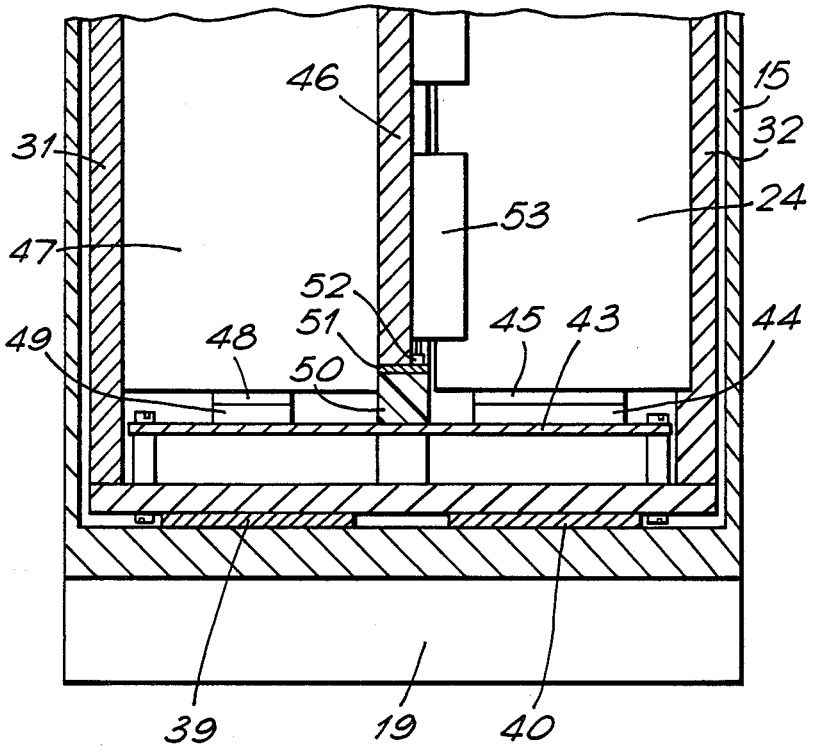
FIG. 4 is a sectional elevation of the assembly of FIG. 2 taken along plane B—B.

Referring next to FIG. 4, a PTFE bar 50 and a gold-plated metallic conductor 51 are disposed between divider 46 and "mother" P.C.B. 43. Each amplifier P.C.B. 20–29 is fitted with a PTFE contact mounting 53 which locates in the grooves in divider 46. When the amplifier P.C.B. is inserted, a spring loaded contact 52 connects with the gold plated conductor 51 as shown in FIG. 4. In this way the leakage resistance of the circuit connected to contact 52 is maintained at a very high value. A very stable constant current generator is connected to conductor 51 and is used to feed a known calibration current into each amplifier as required, as in conventional amplifiers of this type.

Figure 5:
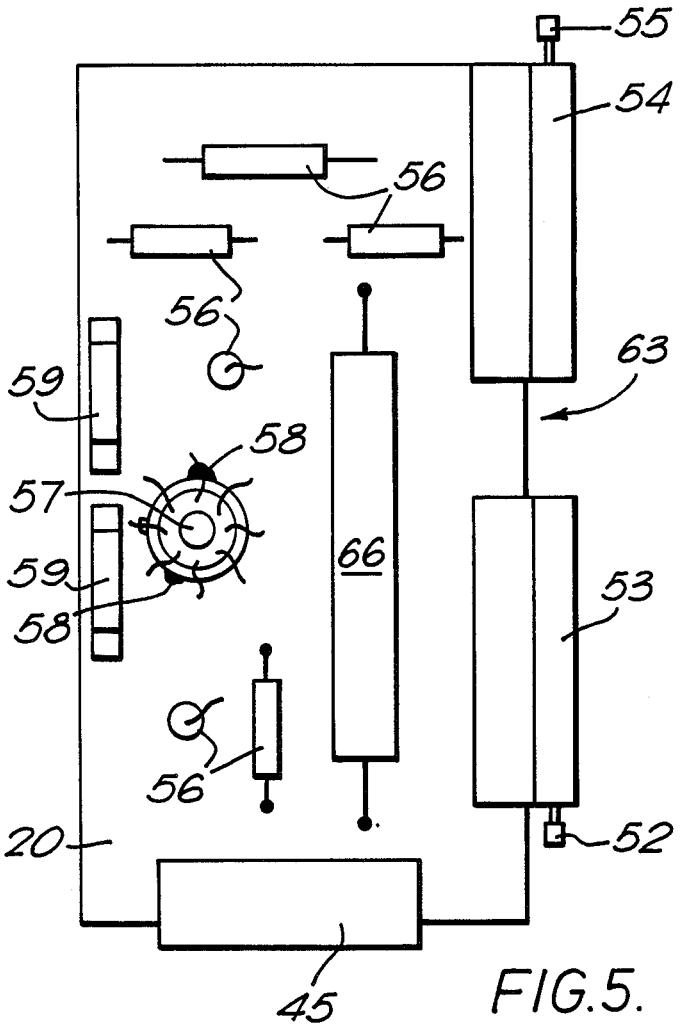
FIG. 5 is a drawing of a printed circuit board suitable for use in the assembly shown in FIG. 2.

Referring to FIG. 5, a second PTFE contact mounting 54, carrying a second spring-loaded contact 55, is also fitted to boards 20–29. Boards 20–29 are positioned in inner box SO so that each contact 55 engages with one of the feedthroughs 60 (FIG. 7) when the amplifier housing 15 is located on detector housing 8. In this way a very low leakage conducting path is provided for current from the ion collecting means.

Figure 6:
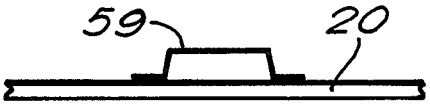
FIG. 6 is a drawing of a copper spring fitted to the board shown in FIG. 5.

Also shown in FIG. 5 in a schematic way are the amplifying element 57, which is typically an integrated circuit in a metal case; some of the associated electronic components 56 and input resistor 66, which comprise the amplifying means of this embodiment. Amplifying element 57 is a low bias current electrometer D.C. operational amplifier of the type conventionally used in mass spectrometers for amplifying the small currents obtained from Faraday cup collectors. In order to provide good thermal contact between amplifying element 57 and the cooled inner box 30 the metal case of element 57 is soldered to the metallic coating of the board as indicated at 58, and two thermally conducting spring means 59 are soldered to the coating, close to the edge of the board. Spring means 59 are arranged to contact the wall of the groove in side plate 31 or 32 when the board is inserted, and the amplifying element 57 is positioned as close as possible to the springs. FIG. 6 illustrates the spring means 59 in more detail. The grooves in side plates 31 and 32 are wider than the thickness of the boards which are inserted in them, as shown in FIG. 2, in order to accommodate the spring means 59.

In order to complete the current measurement circuitry, power supply 64 (FIG. 1) is connected via connector 18 to provide power for operating the amplifying means inside housing 15, and the outputs of the amplifying means are taken via output signal conditioner 65 to a suitable recorder or computer data system. Suitable power supplies and conditioners are well known in the art.

It will be appreciated that the circuitry enclosed in the inner box 30 should be designed to dissipate as little heat as possible in order to minimize the amount of heat which has to be transferred by the heat pumps. Consequently, as many of the heat dissipating components as possible should be incorporated in units 41, 64 and 65, and only those components directly associated with the amplifying element 57 should be located within box 30.

It will also be appreciated that the heat pumps 39, 40 can, if suitable devices are employed, be used to heat the inner box SO to room temperature prior to admitting air to housing 15 and servicing the amplifier. With Peltier devices, this may be done by simply reversing the polarity of the power supply, and can save a considerable period of time in servicing. It is not advisable to admit air into housing 15 whilst the temperature of box 30 is below ambient, otherwise excessive quantities of water and other contaminants may condense on the critical components.

Typically, the heat pumps 39 and 40 should be such that the inner box 30 is maintained at a temperature between 0° and 5° C., and sensor 42 and unit 41 should be adapted to control the temperature of the inner box to within ±0.002° C.. In this way the temperature of the input resistor 66 can be maintained within 0.01° C., assuming that conventional components are employed and that no components which dissipate a lot of heat are present in the inner box 30.

What is claimed is:

1. An apparatus comprising a mass spectrometer including at least one ion-collecting means disposed to receive ions subsequent to their mass analysis and produce an electrical current substantially proportional to the number of ions striking said at least one ion-collecting means, the improvement comprising at least one current amplifier means for amplifying the electrical current produced by said at least one ion-collecting means, said at least one current amplifier means being disposed in a substantially sealed housing and comprising a plurality of electronic components, at least one of said components being an amplifying element; means for maintaining the pressure within said substantially sealed housing substantially below atmospheric pressure; means for cooling at least said amplifying element to a temperature substantially below 20° C.; and means for maintaining substantially constant the temperature of at least one of said electronic components.

2. The apparatus of claim 1 wherein the mass spectrometer comprises a plurality of ion collecting means disposed along the mass focal plane of said spectrometer so that each collecting means receives substantially only ions of one mass-to-charge ratio, and wherein said improvement comprises a plurality of current amplifier means disposed in said sealed housing, each of said ion-collecting means being connected to a different one of said current amplifier means, said plurality of amplifier means permitting the electrical currents produced by at least two of said ion-collecting means to be simultaneously determined.

3. The apparatus of claim 1 wherein said amplifying element comprises an integrated circuit electrometer operational amplifier and said means for cooling maintains the temperature of said amplifying element below +10° C..

4. The apparatus of claim 3 wherein said means for cooling maintains the temperature of said amplifying element between 0° C. and 5° C..

5. The apparatus of claim 2 wherein said amplifying element comprises an integrated circuit electrometer operational amplifier and said means for cooling maintains the temperature of said amplifying element between 0° C. and +5° C..

6. The apparatus of claim 1 wherein said plurality of electronic components further comprises a resistor connected to an input of said amplifying element and wherein said means for maintaining substantially constant the temperature of at least one of said electronic components maintains the temperature of said resistor to within ±0.1° C..

7. The apparatus of claim 6 wherein said means for maintaining temperature maintains the temperature of said resistor to within ±0.1° C..

8. The apparatus of claim 2 wherein said plurality of electronic components includes a resistor connected to the input of said amplifying element and wherein said means for maintaining substantially constant the temperature of at least one of said electronic components maintains the temperature of said resistor to within ±0.01° C..

9. The apparatus of claim 1 wherein said improvement further comprises an inner box at least partly constructed from thermally conducting material, said at least one current amplifier means being disposed within said inner box, said inner box being disposed within said sealed housing, a continuous thermally conducting path being provided between said inner box and said amplifying element, and wherein said means for cooling cools said inner box.

10. The apparatus of claim 9 wherein said improvement further comprises at least one circuit board having a thermally conducting metallic coating disposed in said inner box with said coating in thermal contact with said inner box, said amplifying element being maintained in thermal contact with said coating.

11. The apparatus of claim 10 wherein said at least one circuit board is located in a groove provided in a wall of said inner box and at least one thermally conducting spring means is provided on said board to provide a thermally conductive path between said thermally conducting coating and said inner box.

12. The apparatus of claim 2 wherein said improvement further comprises one inner box at least partly constructed from thermally conducting material, all of said current amplifier means being disposed within said one inner box, said inner box being disposed within said sealed housing, a continuous thermally conducting path being provided between said inner box and each of the amplifying elements, and wherein said means for cooling cools said inner box.

13. The apparatus of claim 12 wherein at least one circuit board having a thermally conducting metallic coating is disposed in said inner box with said coating in thermal contact with said inner box, and wherein said amplifying element is maintained in thermal contact with said coating.

14. The apparatus of claim 13 wherein said at least one circuit board is located in a groove provided in a wall of said inner box and wherein at least one thermally conducting spring means is mounted on said board to provide a thermally conductive path between said thermally conducting coating and said inner box.

15. The apparatus of claim 9 wherein said plurality of components includes a resistor connected to an input of said amplifying element, said resistor being positioned to allow radiative transfer of heat between the surface thereof and said inner box, and wherein said means for maintaining substantially constant the temperature maintains substantially constant the temperature of said inner box.

16. The apparatus of claim 15 wherein the temperature of said inner box is maintained within ±0.002° C..

17. The apparatus of claim 12 wherein said plurality of components comprising each of said current amplifier means includes a resistor connected to an input of the amplifying element, the resistors being positioned to allow radiative transfer of heat between the surfaces thereof and said inner box, and wherein said means for maintaining substantially constant the temperature maintains substantially constant the temperature of said inner box.

18. The apparatus of claim 17 wherein the temperature of said inner box is maintained within ±0.002° C..

19. The apparatus of claim 9 wherein said means for cooling comprises at least one heat pump disposed between said inner box and said sealed housing.

20. The apparatus of claim 12 wherein said means for cooling comprises at least one heat pump disposed between said inner box and said sealed housing.

21. An improved method for the operation of a mass spectrometer having plural ion collectors disposed along a mass focal plane, the ion collectors receiving substantially only ions of a single mass-to-charge ratio and providing an electrical current substantially proportional to the number of ions impinging thereon, an integrated circuit electrometer operational amplifier being connected to each ion collector and each of the amplifiers having at least a first resistor connected to an input thereof, said improved method comprising:

cooling said amplifiers to a temperature substantially below 20° C.;

maintaining said amplifiers in a closed environment wherein the pressure is maintained substantially below atmospheric pressure; and maintaining the temperature of the first resistors within ±0.1° C..

* * * * *